US006824944B2

(12) United States Patent
Sacripante et al.

(10) Patent No.: US 6,824,944 B2
(45) Date of Patent: Nov. 30, 2004

(54) TONER

(75) Inventors: Guerino G. Sacripante, Oakville (CA); Valerie M. Farrugia, Oakville (CA); Michael S. Hawkins, Cambridge (CA)

(73) Assignee: Xerox Corporation, Stamford, CT (US)

( * ) Notice: Subject to any disclaimer, the term of this patent is extended or adjusted under 35 U.S.C. 154(b) by 129 days.

(21) Appl. No.: 10/369,923

(22) Filed: Feb. 20, 2003

(65) Prior Publication Data

US 2004/0166430 A1 Aug. 26, 2004

(51) Int. Cl.[7] ..... G03G 9/00
(52) U.S. Cl. ..... 430/137.1; 430/108.3
(58) Field of Search ..... 430/137.1, 108.3

(56) References Cited

U.S. PATENT DOCUMENTS

| | | | | |
|---|---|---|---|---|
| 4,465,756 | A | 8/1984 | Mikami et al. | 430/138 |
| 4,468,446 | A | 8/1984 | Mikami et al. | 430/138 |
| 4,533,616 | A | 8/1985 | Ohsaki et al. | 430/110 |
| 4,565,763 | A | 1/1986 | Uchiyama et al. | 430/109 |
| 4,592,990 | A | 6/1986 | Takagi et al. | 430/137 |
| 4,601,968 | A | 7/1986 | Hyosu | 430/137 |
| 4,626,490 | A | 12/1986 | Yamazaki et al. | 430/138 |
| 4,789,617 | A | 12/1988 | Arahara et al. | 430/137 |
| 4,797,339 | A | 1/1989 | Maruyama et al. | 430/139 |
| 4,904,562 | A | 2/1990 | Yusa et al. | 430/138 |
| 5,213,938 | A | 5/1993 | Sacripante et al. | 430/137 |
| 5,348,832 | A | 9/1994 | Sacripante et al. | 430/109 |
| 5,593,807 | A | 1/1997 | Sacripante et al. | 430/137 |
| 5,604,076 | A | 2/1997 | Patel et al. | 430/137 |
| 5,648,193 | A | 7/1997 | Patel et al. | 430/137 |
| 5,658,704 | A | 8/1997 | Patel et al. | 430/137 |
| 5,660,965 | A | 8/1997 | Mychajlowskij et al. | 430/137 |
| 5,840,462 | A | 11/1998 | Foucher et al. | 430/137 |
| 5,843,614 | A | 12/1998 | Shinzo et al. | 430/137 |
| 5,853,944 | A | 12/1998 | Foucher et al. | 430/137 |
| 6,143,457 | A | 11/2000 | Carlini et al. | 430/110 |
| 6,203,963 | B1 | 3/2001 | Duff et al. | 430/137 |

OTHER PUBLICATIONS

Sung–Kee Chang, Guangdian Han, A Convenient Deoxygenation of Sulfoxides With Co (II) and $NaBH_4$, 1982, pp. 903–906, *Synthetic Communications*, 12(11).

*Primary Examiner*—Mark A. Chapman
(74) *Attorney, Agent, or Firm*—E. O. Palazzo

(57) ABSTRACT

A toner process involving, for example, contacting a toner surface with a reducing agent and a metal halide.

30 Claims, No Drawings

TONER

The present invention is generally directed to toner compositions and processes thereof, and more specifically, to the surface modification of compositions and components, such as toners, including chemical toners, such as in situ, encapsulated or emulsion aggregated toners, and toner compositions directly generated by conventional melt kneading, pulverization and classification process. In embodiments, the present invention is generally directed to a toner process, and more specifically, the present invention relates to a toner process wherein the toner surface is chemically modified by a reduction process to provide, for example, positively charging toners converted from toners that have tendencies to charge negatively. Typically, for example, toners containing polyester resins with sulfonic acid or carboxylic acid groups tend to charge negatively, and with the present invention in embodiments can be initially rendered as positively charging toners. More specifically, the present invention is directed to a toner process wherein the surface layer of the toner is chemically modified by a reducing agent, the gain of electrons, for example, with an aqueous solution of reducing agent, such as sodium borohydride and a metal halide catalyst, such cobalt (II) chloride thereby, for example, enhancing the surface charging performance of the toner particles and enabling positive triboelectric charge values of, for example, from about 10 to about 90 microcoulombs per gram, and preferably from about 20 to about 40 microcoulombs per gram, respectively.

In embodiments, the present invention is directed to the economical in situ, chemical or direct preparation of toners comprised of a resin, a colorant, optionally a wax, and wherein the toner surface layer is chemically modified by a reduction process with an aqueous solution of a reducing agent, such as sodium borohydride, and a metal halide catalyst, such cobalt (II) chloride, thereby, for example, enhancing the surface charging characteristics of the toner particles and enabling high positive triboelectric charge levels; and sulfopolyester based toner obtained by an emulsion coalescence process, and which process is comprised of (i) subjecting a colloidal aqueous solution comprised of, for example, about 10 to about 20 percent solids of, for example, sodio-sulfonated polyester resin particles, and coalescing the resin with a coalescence agent comprised of, for example, zinc acetate as disclosed in U.S. Pat. No. 5,593,807, the disclosure of which is totally incorporated herein by reference; and (ii) treatment of the toner by a reduction process with an aqueous solution of reducing agent, such as sodium borohydride and metal halide catalyst, such cobalt (II) chloride, and thereby, for example, enhancing the surface charging characteristics of the toner particles and providing positively triboelectric charge levels of from about 10 to about 90 microcoulombs per gram, and preferably from about 20 to about 40 microcoulombs per gram, respectively. The resulting surface treated toner particles display in embodiments enhanced triboelectric charging levels, especially in the higher 80 percent relative humidity zone, and lower RH sensitivity of charging performance between the 20 percent relative humidity zone and the 80 percent relative humidity zone without compromising the low melt toner fusing properties, and wherein the toner minimum fusing temperature is, for example, from about 125° C. to about 140° C. as determined at a crease area of about 60 units, and which toner also possesses in embodiments high gloss characteristics with peak gloss levels of, for example, from about 40 to about 70 gloss units as measured with a Gardner gloss meter.

The toner composites or compositions of the present invention display in embodiments thereof an average volume diameter of, for example, from about 1 to about 25, and preferably from 1 to about 10 microns, and a narrow GSD of, for example, from about 1.16 to about 1.26 or about 1.18 to about 1.28, both as measured on the Coulter Counter; a particle morphology which is nearly spherical in shape; and low or no vinyl offset of from about 0.03 to about 0.11 percent, measured as the percentage of toner mass transferred from a fused image transferred onto a MYLAR® sheet over a period of 48 hours at 50° C. The process of the present invention in embodiments enables the utilization of polymers obtained by polycondensation reactions, such polymers including, for example, polyesters, and more specifically, the sulfonated polyesters as illustrated in U.S. Pat. Nos. 5,348,832; 5,658,704, 5,604,076, and 5,593,807, the disclosures of each of which are totally incorporated herein by reference, and which polyesters may be selected for low melting toners.

The toners of the present invention can be selected for known electrophotographic imaging methods, printing processes, including color processes, digital methods, and lithography.

REFERENCES

Patents which may disclose the surface modification of certain toners are known. More specifically, illustrated in U.S. Pat. No. 5,213,938, the disclosure of which is totally incorporated herein by reference, is a process for the preparation of toner compositions, which comprises the oxidation and metal chelation of the toner surface, and subsequently coalescing by absorption of a fluoro containing polymer to provide negative charging toners.

U.S. Pat. No. 6,143,457, the disclosure of which is totally incorporated herein by reference, discloses a toner comprised of a polyester resin, colorant and thereover a quaternary organic component ionically bound to the toner surface, thereby enhancing negative charging toner and reducing the relative humidity sensitivity. Moreover, in U.S. Pat. No. 6,203,963, the disclosure of which is totally incorporated herein by reference, there is disclosed a toner particulate surface treatment comprised of treating an aqueous dispersion of toner particles with a first solution of a water soluble alkyl carboxylate metal salt and a second solution of water soluble metal salt resulting in toner particles uniformly coated with colloidal particles.

U.S. Pat. No. 4,626,490, the disclosure of which is totally incorporated herein by reference, discloses an encapsulated toner comprised of a core material comprised of a long chain organic compound and a higher carboxylic acid encapsulated with a thin shell, and an external additive comprised of a powdery silica. There is also disclosed in U.S. Pat. No. 4,797,339, the disclosure of which is totally incorporated herein by reference, an in situ toner comprising an inner layer comprised of a resin ion complex having a coloring agent and an outer layer containing a flowability imparting agent; see column 5, lines 3 to 13, wherein the flowability imparting agents in addition to the perfluoroalcohol acrylate agent includes a benzo derivative formaldehyde resin and hydrophobic silica. Similarly, U.S. Pat. Nos. 4,789,617; 4,601,968; 4,592,990; 4,904,562; 4,465,756; 4,468,446; 4,533,616; 4,565,763 and 4,592,990, the disclosures of which are totally incorporated herein by reference, disclose the use of external toner surface additives.

Polyester based chemical toners substantially free of encapsulation are also known, reference U.S. Pat. No. 5,593, 807, the disclosure of which is totally incorporated herein by reference, wherein there is illustrated a process for the preparation of a toner comprised of a sodio sulfonated polyester resin and pigment, and wherein the aggregation and coalescence of resin particles is mediated with an alkali halide. Other U.S. Patents that may be of interest, the disclosures of which are totally incorporated herein by reference, are U.S. Pat. Nos. 5,853,944; 5,843,614; 5,840,462; 5,604,076; 5,648,193; 5,658,704 and 5,660,965.

SUMMARY

It is a feature of the present invention to provide dry toner compositions with positive triboelectric charging, such as from about 50 to about 90 microcoulombs per gram, and preferably from about 10 to about 40 microcoulombs per gram, respectively.

In another feature of the present invention there are provided toners wherein the surface thereof is chemically modified by a reduction process to provide a positive charging toner.

It is another feature of the present invention to provide a toner wherein the surface layer of the toner is chemically modified by a reduction process with an aqueous solution of reducing agent, such as sodium borohydride, and a metal halide catalyst, such cobalt (II) chloride, and thereby, for example, enhancing the surface charging performance of the toner particles enabling positive triboelectric charge levels in the range of from about 10 to about 90 microcoulombs per gram, and preferably from about 20 to about 40 microcoulombs per gram, respectively.

In another feature of the present invention there are provided simple and economical chemical processes for the preparation of toner compositions with, for example, a polyester core with incorporated colorant and wherein the surface is chemically modified by a reduction process.

In a further feature of the present invention there is provided surface treated toner particles with enhanced charging performance characteristics, such as triboelectric charging levels at both low and high humidity zones (20 percent and 80 percent relative humidity, respectively), minimized RH sensitivity, and narrow charge distributions determined by the half-width on the known charge spectrograph.

Also, in another feature of the present invention there is provided surface treated toner particles with excellent fusing characteristics for digital color printing applications, low fusing temperatures of from about 130° C. to about 150° C., high gloss performance measuring greater than about 60, such as from about 60 to about 90 gloss units as measured on a Gardner gloss metering unit, and low vinyl offset.

In a further feature of the present invention there is provided a simple sequential process for the preparation of toner size particles with, for example, an average volume diameter of from about 3 to about 10 microns with a narrow GSD of from about 1.18 to about 1.26, and wherein the toner is chemically surface treated by heating at temperatures of about 25° C. to about 50° C. with an aqueous solution of sodium borohydride and catalyst such as cobalt (II) chloride.

Moreover, in another feature of the present invention there is provided a process for the preparation of toner compositions, which possess observable spherical morphology, non-spherical morphology, or mixtures thereof, with an average particle volume diameter of from between about 1 to about 20 microns, and preferably from about 1 to about 9 microns, and with a narrow GSD of from about 1.12 to about 1.30, and more specifically, from about 1.14 to about 1.25, each as measured with a Coulter Counter.

In yet another feature of the present invention there are provided toner compositions with low fusing temperatures of from about 110° C. to about 130° C., and with excellent blocking characteristics of from about 50° C. to about 60° C., and preferably from about 55° C. to about 60° C.

Moreover, in another feature of the present invention there are provided toner compositions with a high projection efficiency, such as from about 75 to about 95 percent efficiency as measured by the Match Scan II spectrophotometer available from Milton-Roy.

In a further feature of the present invention there are provided toner compositions which result in minimal, low, or no paper curl.

Aspects of the present invention relate to a toner process comprised of contacting a toner surface with a reducing agent and a metal halide; a toner process wherein there is selected a metal halide catalyst selected from the group comprised of cobalt (II) chloride, cobalt (II) bromide, cobalt (II) iodide, cobalt (II) fluoride, tin (II) chloride, tin (II) bromide, tin (II) iodide, tin (II) fluoride, zinc (II) chloride, zinc (II) bromide, zinc (II) iodide, zinc (II) fluoride, paladium (II) chloride, paladium (H) bromide, paladium (H) iodide, paladium (II) fluoride, cadmium (II) chloride, cadmium (II) bromide, cadmium (II) iodide, cadmium (II) fluoride, antimony (II) chloride, antimony (II) bromide, antimony (II) iodide, antimony (II) fluoride, copper (II) chloride, copper (II) bromide, copper (II) iodide, copper (II) fluoride, nickel (II) chloride, nickel (II) bromide, nickel (II) iodide, and nickel (II) fluoride; a toner process wherein there is selected a metal halide in an amount of from about 0.5 to about 10 weight percent of the toner and a reducing agent selected in an amount of from about 0.5 to about 10 percent by weight of the toner; a toner process resulting in a toner product comprised of resin, colorant, and a substantially deoxygenated surface, and wherein there is present on the surface of the toner carboxylic acid groups and sulfonate groups, and which groups can be contacted with a reducing agent; a process for generating a charge on a toner comprised of subjecting the toner surface to mixing with a reducing agent and a metal halide; a toner process wherein the toner product obtained is comprised of resin and colorant, and wherein the surface characteristics of the toner are converted from an initial state to a final positively charged state by the reducing agent; a toner process comprising contacting the entire surface of a toner with a reducing agent and a metal halide catalyst, and wherein the metal halide is selected from the group comprised of cobalt (II) chloride, cobalt (II) bromide, cobalt (II) iodide, cobalt (II) fluoride, tin (II) chloride, tin (II) bromide, tin (II) iodide, tin (II) fluoride, zinc (II) chloride, zinc (II) bromide, zinc (II) iodide, zinc (II) fluoride, paladium (II) chloride, paladium (II) bromide, paladium (II) iodide, paladium (II) fluoride, cadmium (II) chloride, cadmium (II) bromide, cadmium (II) iodide, cadmium (II) fluoride, antimony (II) chloride, antimony (II) bromide, antimony (II) iodide, antimony (II) fluoride, copper (II) chloride, copper (II) bromide, copper (II) iodide, copper (II) fluoride, nickel (II) chloride, nickel (II) bromide, nickel (II) iodide, and nickel (II) fluoride, and wherein the metal halide and the reducing agent are mixed with a toner slurry and the resulting mixture is heated; a toner comprised of a resin, colorant, and wherein the surface layer of the toner is chemically modified by a reduction process with an aqueous solution containing a reducing agent, such as sodium borohydride, and a metal halide catalyst, such cobalt (II) chloride, and thereby, for example, enhancing the surface charging performance of the toner particles enabling high positive triboelectric charge levels of from about 50 to about 90 microcoulombs per gram, and preferably from about 10 to about 40 microcoulombs per gram, respectively; a toner process (i) comprising mixing a colloidal solution of a sodio sulfonated polyester resin with, for example, a particle size diameter of from about 10 to about 80 nanometers, and preferably from about 10 to about 40 nanometers, and a colorant; (ii) adding thereto an aqueous solution containing about 1 to about 10 percent by weight in water at neutral pH of a coalescence agent comprised, for example, of an ionic salt of the Group II or Group XIII metals or the transition metals of Groups II to XII, such as for example, the halide (fluoride, chloride, bromide, iodide), acetate, or sulfate salts of zinc, copper, cadmium, manganese, vanadium, nickel, niobium, chromium, iron, zirconium, scandium and the like; (iii) optionally cooling and optionally adding to the toner composition formed wax, charge additive, and surface flow additives; (iv) isolating, filtering, washing the toner, and optionally drying; and (v) wherein the wet toner solids may be redispersed in water and chemically treated with 10 percent by weight of cobalt (II) chloride (relative to dry toner) and 1.5 percent by weight of sodium borohydride (relative to dry toner); the mother liquor is initially removed and the toner slurry is concentrated to 25 percent by weight of solids content, and heated to 30° C.; cobalt (II) chloride can then be added dropwise to the resulting toner slurry over a period of 10 to 15 minutes; subsequently sodium borohydride can be added slowly to the resulting toner slurry (containing cobalt (II) chloride) in a manner to avoid foam overflow from the flask, selected, heated (30° C.) and stirred (200 rpm) for 19 hours, cooled to room temperature, filtered and washed five times until the conductivity of filtrate was about 20 $\mu$S/cm; a toner process comprised of subjecting a toner slurry containing about 27 grams of dry toner to mixing with about 10 percent by weight of cobalt (II) chloride (relative to dry toner) and 1.5 percent by weight of sodium borohydride (relative to dry toner), and wherein the mother liquor can be initially removed, and wherein the toner slurry is concentrated to 25 percent by weight of solids, and thereafter heating at, for example, about 30° C.; and wherein the cobalt (II) chloride is added dropwise to the toner slurry over a period of about 10 minutes; and sodium borohydride is added very slowly to the toner slurry (containing cobalt (II) chloride) so that the evolution of black foam did not overflow the flask; the resulting toner slurry can then be stirred (200 rpm) for about 19 hours, followed by cooling to room temperature, about 22 to about 25° C., filtered and washed until the conductivity of filtrate was equal to or below about 20 $\mu$S/cm, for example, from about 0 to about 20; a toner process wherein there is accomplished the chemical reduction of the toner surface with a reducing component, or components like an aqueous solution of sodium borohydride and an aqueous solution of a metal halide with a sodium borohydride concentration of from about 0.5 to about 15 percent.

Examples of reducing agents that can be selected include suitable components, inclusive of known reducing agents, such as sodium borohydride, sodium hydride, potassium hydride, potassium borohydride, lithium hydride, lithium borohydride, and the like, each selected in an amount of, for example, from about 0.5 to about 5 weight percent of the toner, and more specifically, from about 1.5 to about 5 percent by weight.

Examples of metal halides that can be utilized are, for example, selected from the group comprised of cobalt (II) chloride, cobalt (II) bromide, cobalt (II) iodide, cobalt (II) fluoride, tin (II) chloride, tin (II) bromide, tin (II) iodide, tin (II) fluoride, zinc (II) chloride, zinc (II) bromide, zinc (II) iodide, zinc (II) fluoride, paladium (II) chloride, paladium (II) bromide, paladium (II) iodide, paladium (II) fluoride, cadmium (II) chloride, cadmium (II) bromide, cadmium (II) iodide, cadmium (II) fluoride, antimony (II) chloride, antimony (II) bromide, antimony (II) iodide, antimony (II) fluoride, copper (II) chloride, copper (II) bromide, copper (II) iodide, copper (II) fluoride and the like, including known suitable catalysts. The metal halide amount is, for example, from about 1 to about 15, and more specifically, from about 3 to about 10 weight percent of the toner.

The toner resin can be selected from known suitable resins, such as a polyester, which in embodiments is preferably a sodio sulfonated polyester resin, as illustrated in, for example, U.S. Pat. Nos. 5,348,832; 5,853,944; 5,840,462; 5,660,965; 5,658,704; 5,648,193; and 5,593,807, the disclosures of each patent being totally incorporated herein by reference. Specific examples polyester resins are the beryllium salt of copoly(1,2-propylene-dipropylene-5-sulfoisophthalate)-copoly(1,2-propylene-dipropylene terephthalate), the barium salt of copoly(1,2-propylene-diethylene-5-sulfoisophthalate)-copoly(1,2-propylene-diethylene terephthalate), the magnesium salt of copoly(1,2-dipropylene-5-sulfoisophthalate)-copoly(1,2-propylene terephthalate), the magnesium salt of copoly(1,3-butylene-5-sulfoisophthalate)-copoly(1,3-butylene terephthalate), the calcium salt of copoly(1,2-dipropylene-5-sulfoisophthalate)-copoly (1,2-propylene terephthalate), the calcium salt of copoly(1,3-butylene-5-sulfoisophthalate)-copoly(1,3-butylene terephthalate), the cobalt salt of copoly (1,2-propylene-diethylene-5-sulfoisophthalate)-copoly (1,2-propylene-diethylene terephthalate), the nickel salt of copoly(1,2-dipropylene-5-sulfoisophthalate)-copoly(1,2-propylene terephthalate), the iron salt of copoly(1,3-butylene-5-sulfoisophthalate)-copoly(1,3-butylene terephthalate), the zirconium salt of copoly(1,2-dipropylene-5-sulfoisophthalate)-copoly (1,2-propylene terephthalate), the chromium salt of copoly(1,3-butylene-5-sulfoisophthalate)-copoly(1,3-butylene terephthalate), and the like.

Various known colorants, especially pigments, present in the toner in an effective amount of, for example, from about 1 to about 65, and more specifically, from about 2 to about 35 percent by weight of the toner, and yet more specifically, in an amount of from about 1 to about 15 weight percent, and wherein the total of all toner components is about 100 percent, include carbon black like REGAL 330®; magnetites such as Mobay magnetites MO8029™, MO8060™; and the like. As colored pigments, there can be selected known cyan, magenta, yellow, red, green, brown, blue or mixtures thereof. Specific examples of colorants, especially pigments, include phathalocyanine HELIOGEN BLUE L6900™, D6840™, D7080™, D7020™, cyan 15:3, magenta Red 81:3, Yellow 17, the pigments of U.S. Pat. No. 5,556,727, the disclosure of which is totally incorporated herein by reference, and the like. Examples of specific magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of specific cyans that may be selected include copper tetra (octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative specific examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The colorants, such as pigments, selected can be flushed pigments as indicated herein.

A number of specific colorant examples include Pigment Blue 15:3 having a Color Index Constitution Number of 74160, magenta Pigment Red 81:3 having a Color Index Constitution Number of 45160:3, and Yellow 17 having a Color Index Constitution Number of 21105, and known dyes such as food dyes, yellow, blue, green, red, magenta dyes, and the like. Colorants include pigments, dyes, mixtures of pigments, mixtures of dyes, and mixtures of dyes and pigments, and the like, and more specifically pigments.

Dry powder additives that can be added or blended onto the surface of the toner compositions after washing or drying include, for example, metal salts, metal salts of fatty acids, colloidal silicas, metal oxides like titanium, tin and the like, mixtures thereof and the like, which additives are each usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and flow aids, such as fumed silicas like AEROSIL R972® available from Degussa, or silicas available from Cabot Corporation or Degussa Chemicals; the coated silicas of U.S. Pat. No. 6,190,815 and U.S. Pat. No. 6,004,714, the disclosures of each patent being totally incorporated herein by reference, and the like, each additive being present, for example, in amounts of from about 0.1 to about 2 percent, and which additives can be added during aggregation process or blended into the formed toner product.

Developer compositions can be prepared by mixing the toners with known carrier particles, including coated carriers, such as steel, ferrites, and the like, reference U.S. Pat. Nos. 4,937,166 and 4,935,326, the disclosures of which are totally incorporated herein by reference, at, for example from about 2 percent toner concentration to about 8 percent toner concentration.

Imaging methods are also envisioned with the toners of the present invention, reference for example a number of the patents mentioned herein, and U.S. Pat. No. 4,265,990, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

EXAMPLE I

Preparation of Sodio Sulfonated Polyester

A linear sulfonated random copolyester resin comprised of, on a mol percent, 0.465 of terephthalate, 0.035 of sodium sulfoisophthalate, 0.475 of 1,2-propanediol, and 0.025 of diethylene glycol was prepared as follows. In a 5 gallon Parr reactor equipped with a bottom drain valve, double turbine agitator, and distillation receiver with a cold water condenser were charged 3.98 kilograms of dimethylterephthalate, 451 grams of sodium dimethyl sulfoisophthalate, 3.104 kilograms of 1,2-propanediol (1 mole excess of glycol), 351 grams of diethylene glycol (1 mole excess of glycol), and 8 grams of butyltin hydroxide oxide catalyst. The reactor was then heated to 165° C. with stirring for 3 hours whereby 1.33 kilograms of distillate were collected in the distillation receiver, and which distillate was comprised of about 98 percent by volume of methanol and 2 percent by volume of 1,2-propanediol as measured by the ABBE refractometer available from American Optical Corporation. The reactor mixture was then heated to 190° C. over a one hour period, after which the pressure was slowly reduced from atmospheric pressure to about 260 Torr over a one hour period, and then reduced to 5 Torr over a two hour period with the collection of approximately 470 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 530 grams of 1,2-propanediol were collected. The reactor was then purged with nitrogen to atmospheric pressure, and the polymer product discharged through the bottom drain onto a container cooled with dry ice to yield 5.60 kilograms of 3.5 mol percent sulfonated polyester resin, sodio salt of (1,2-propylene-dipropylene-5-sulfoisophthalate)-copoly (1,2-propylene-dipropylene terephthalate). The sulfonated polyester resin glass transition temperature was measured to be 56.6° C. (onset) utilizing the 910 Differential Scanning Calorimeter available from E.I. DuPont operating at a heating rate of 10° C. per minute. The number average molecular weight was measured to be 3,250 grams per mole, and the weight average molecular weight was measured to be 5,290 grams per mole using tetrahydrofuran as the solvent.

EXAMPLE II

Preparation of a Sodio Sulfonated Polyester Colloid Solution

A 15 percent solids concentration of a colloidal sulfonate polyester resin dissipated in an aqueous media was prepared by first heating about 2 liters of deionized water to about 85° C. with stirring, and adding thereto 300 grams of the sulfonated polyester resin obtained above in Example I, followed by continued heating at about 85° C., and stirring of the mixture for a duration of from about one to about two hours, followed by cooling to about room temperature, about 23 to about 25° C. throughout the Examples. The colloidal solution of the sodio sulfonated polyester resin particles possessed a characteristic blue tinge and a particle size of from about 5 to about 150 nanometers, and more specifically, from about 20 to about 40 nanometers, as measured by the NiCOMP® particle sizer.

EXAMPLE III

A 5 Micron Cyan Non-Surface Treated Toner Comprised of a Linear Sulfonated Polyester Core Resin and Pigment Blue 15:3 Colorant A 2 liter colloidal solution containing 15 percent by weight of the sodio sulfonated polyester resin of Example I was charged into a 4 liter kettle equipped with a mechanical stirrer. To this were added 42 grams of a cyan pigment dispersion containing 30 percent by weight of Pigment Blue 15:3 (available from Sun Chemicals), and the resulting mixture was heated to 56° C. with stirring at about 180 to 200 revolutions per minute. To this heated mixture were then added dropwise 760 grams of an aqueous solution containing 5 percent by weight of zinc acetate dihydrate. The dropwise addition of the zinc acetate dihydrate solution was accomplished utilizing a peristaltic pump at a rate of addition of approximately 2.5 milliliters per minute. After the addition was complete (about 5 hours), the mixture was stirred for an additional 3 hours. A sample (about 1 gram) of the reaction mixture was then retrieved from the kettle, and a particle size of 4.9 microns with a GSD of 1.18 was measured by the Coulter Counter. The mixture was then allowed to cool to room temperature, about 25° C., overnight, about 18 hours, with stirring. The product was filtered off through a 3 micron hydrophobic membrane cloth, and the toner cake obtained was reslurried into about 2 liters of deionized water and stirred for about 1 hour. The toner slurry resulting was refiltered and the cake redispersed into about 1.5 liters of deionized water to provide a final slurry concentration of about 20 percent toner solids, and which toner slurry had a conductivity of about 150 microsiemens per centimeter, and was comprised of the above resin, pigment and water of about 10 to about 30 weight percent solids.

EXAMPLE IV

Chemical Surface Treatment of 5 Micron Cyan Toner with 16 Percent by Weight of Cobalt (II) Chloride and 2.4 Percent by Weight of Sodium Borohydride A 550 gram slurry of the toner slurry of Example III, which contained about 14 percent toner solids (solids refers to toner of resin and colorant), was subjected to chemical surface treatment by contacting the toner slurry containing approximately 75 grams of dry toner with 12 grams of cobalt (II) chloride (16 percent by weight toner as a 10 percent aqueous solution) and 1.8 grams of sodium borohydride (2.4 percent by weight toner as a 6 percent aqueous solution). The cobalt (II) chloride was added dropwise to the toner slurry over 10 minutes, and the sodium borohydride was added very slowly to the toner slurry (containing cobalt (II) chloride) so that the evolution of foam did not overflow from the flask. The toner slurry was then heated to 30° C. with stirring at 200 rpm for 19 hours. The treated toner slurry was then cooled to room temperature, filtered and washed five times until the measured conductivity of filtrate was about 16 to about 20 $\mu$S/cm. The cooled surface treated toner slurry was first sieved through a 25 micron stainless steel screen (#500 mesh), and then filtered through a 3 micron hydrophobic membrane cloth. The toner cake was then scurried into 0.5 liter of deionized water, stirred for 30 minutes, then filtered again resulting in a toner composition with modified surface characteristics and comprised of 96 percent by weight of resin and 4 percent by weight of cyan 15:3 pigment, and which toner possessed glass transition temperatures of 54.4° C. (onset), 59.2° C. (midpoint), and 64° C. (offset).

EXAMPLE V

Chemical Surface Treatment of 5 Micron Cyan Toner with 16 Percent by Weight of Cobalt (II) Chloride and 2.4 Percent by Weight of Sodium Borohydride A 335 gram slurry of Example II, which contained about 14 percent toner solids in water, was subjected to a chemical surface treatment by mixing the toner slurry containing approximately 47 grams of dry toner with 7.5 grams of cobalt (II) chloride (16 percent by weight toner as a 10 percent solution) and 1.13 grams of sodium borohydride (2.4 percent by weight toner as a 6 percent solution). The cobalt (II) chloride was added dropwise to the toner slurry over 10 minutes and the sodium borohydride was added very slowly to the toner slurry (containing cobalt (II) chloride) so that the evolution of foam did not overflow the flask. The toner slurry was then heated to 30° C. with stirring at 200 rpm for 19 hours. The resulting treated toner slurry was then cooled to room temperature, filtered and washed five times until the conductivity of filtrate was below about 16 to about 19 $\mu$S/cm). The cooled surface treated toner slurry was first sieved through a 25 micron stainless steel screen (#500 mesh), and then filtered through a 3 micron hydrophobic membrane cloth. The toner cake resulting was then scurried into 0.5 liter of deionized water, stirred for 30 minutes, then filtered again. The dry toner resulting was comprised of 96 percent by weight of resin and 4 percent by weight of cyan 15:3 pigment, and which toner possessed glass transition temperatures of 54.3° C. (onset), 59.2° C. (midpoint), and 64.3° C. (offset).

EXAMPLE VI

Chemical Surface Treatment of 6 Micron Black Toner with 16 Percent by Weight of Cobalt (II) Chloride and 2.4 Percent by Weight of Sodium Borohydride A 989 gram slurry of Example III, which contained about 23 percent solids was subjected to chemical surface treatment by mixing the toner slurry containing approximately 228 grams of solids in water with 36.5 grams of cobalt (II) chloride (16 percent by weight toner as a 23 percent solution) and 5.4 grams of sodium borohydride (2.4 percent by weight toner as a 6 percent solution). The cobalt (II) chloride was added dropwise to the toner slurry over 10 minutes, and the sodium borohydride was added very slowly to the toner slurry (containing cobalt (II) chloride) so that the evolution of foam did not overflow the flask and the resulting toner slurry heated to 30° C. with stirring at 200 rpm for 19 hours. The resulting treated toner slurry was then cooled to room temperature, filtered and washed five times until the conductivity of filtrate was about 17 to 20 $\mu$S/cm. The cooled surface treated toner slurry was first sieved through a 25 micron stainless steel screen (#500 mesh), and then filtered through a 3 micron hydrophobic membrane cloth. The toner cake resulting was then added into 0.5 liter of deionized water, stirred for 30 minutes, and then filtered, resulting in a toner comprised of 96 percent by weight of the above resin and 4 percent by weight of the above cyan 15:3 pigment, and which toner possessed glass transition temperatures of 54.3° C. (onset), 59.2° C. (midpoint), and 64.3° C. (offset).

Triboelectric Charging Properties

Developers were prepared by mixing each of the above toners with a 65 micron Hoaganese steel core coated with 1 percent by weight of a composite of a polymer of PMMA (polymethylmethacrylate containing the conductive carbon black, CONDUCTEX SC ULTRA®, dispersed therein, about 20 weight percent) and conditioned overnight (about 18 hours) at 20 percent and 80 percent RH and charged for 30 minutes on a roll mill. For 5 micron diameter toners, the toner concentration was 4 percent by weight of carrier. Triboelectric charge was measured by the Faraday Cage blow-off technique, and the charging results for the nontreated toner described in the Example above and chemically surface treated toners described in Examples IV to VI are shown in Table 1. The surface treated toners exhibited up to a two fold increase in the charge levels at 20 percent RH and up to a 4 fold increase/improvement in the charge levels at 80 percent RH, thereby causing the RH sensitivity (the ratio of charge level at 20 percent RH versus 80 percent RH) to significantly diminish by about a factor of two. The enhanced tribocharge levels and minimized RH sensitivities observed for the chemically surface treated toners in Examples IV to VI (evaluated without the use of external flow additives) can be of importance for optimum performance within a developer blend.

TABLE I

| Toner ID | Chemical Surface Treatment | Carrier | q/d, fCoul/ μg (20 Percent RH) | q/d, fCoul/ μg (80 Percent RH) | q/d RH Ratio |
|---|---|---|---|---|---|
| Example III | None | Imar7-2 | −0.90 | −21.59 | 0.04 |
| | | SK276 | −1.22 | −19.09 | 0.06 |
| | | FC076 | −1.55 | −22.43 | 0.07 |
| Example IV | 16 percent $COCl_2.H_2O$ 2.4 percent $NaBH_5$ | Imar7-2 | +0.77 | +4.16 | 0.19 |
| Example V | 16 percent $CoCl_2.H_2O$ 2.4 percent $NaBH_5$ | SK276 | +3.34 | +5.94 | 0.56 |
| | | FC076 | +5.58 | +10.90 | 0.51 |
| Example VI | 16 percent $CoCl_2.H_2O$ 2.4 percent $NaBH_5$ | SK276 | +3.10 | +7.44 | 0.42 |
| | | FC076 | +3.55 | +6.43 | 0.55 |

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A process comprised of contacting a toner surface with a reducing agent and a metal halide catalyst.

2. A process in accordance with claim 1 wherein said metal halide catalyst is selected from the group comprising of cobalt (II) chloride, cobalt (II) bromide, cobalt (II) iodide, cobalt (II) fluoride, tin (II) chloride, tin (II) bromide, tin (II) iodide, tin (II) fluoride, zinc (II) chloride, zinc (II) bromide, zinc (II) iodide, zinc (II) fluoride, paladium (II) chloride, paladium (II) bromide, paladium (II) iodide, paladium (II) fluoride, cadmium (II) chloride, cadmium (II) bromide, cadmium (II) iodide, cadmium (II) fluoride, antimony (II) chloride, antimony (II) bromide, antimony (II) iodide, antimony (II) fluoride, copper (II) chloride, copper (II) bromide, copper (II) iodide, copper (II) fluoride, nickel (II) chloride, nickel (II) bromide, nickel (II) iodide, and nickel (II) fluoride.

3. A process in accordance with claim 1 wherein said reducing agent is sodium borohydride, sodium hydride, potassium hydride, potassium borohydride, lithium hydride, or lithium borohydride.

4. A process in accordance with claim 1 wherein said halide is fluoride, chloride, bromide, or iodide.

5. A process in accordance with claim 1 wherein said reducing agent is sodium borohydride.

6. A process in accordance with claim 1 wherein said metal halide catalyst is cobalt (II) chloride, cobalt (II) bromide, cobalt (II) Iodide, or cobalt (II) fluoride.

7. A process in accordance with claim 1 wherein said metal halide and said reducing agent are mixed with an aqueous toner slurry at a temperature of from about 20° C. to about 50° C.

8. A process in accordance with claim 7 wherein said reducing agent is sodium borohydride, sodium hydride, potassium hydride, potassium borohydride, lithium hydride, or lithium borohydride.

9. A process in accordance with claim 7 wherein said metal halide is cobalt (II) chloride, cobalt (II) bromide, cobalt (II) iodide, cobalt (II) fluoride, tin (II) chloride, tin (II) bromide, tin (II) iodide, tin (II) fluoride, zinc (II) chloride, zinc (II) bromide, zinc (II) iodide, zinc (II) fluoride, paladium (II) chloride, paladium (II) bromide, paladium (II) iodide, paladium (II) fluoride, cadmium (II) chloride, cadmium (II) bromide, cadmium (II) iodide, cadmium (II) fluoride, antimony (II) chloride, antimony (II) bromide, antimony (II) iodide, antimony (II) fluoride, copper (II) chloride, copper (II) bromide, copper (II) iodide, and copper (II) fluoride.

10. A process in accordance with claim 1 wherein said metal halide is selected in an amount of from about 0.5 to about 10 weight percent of said toner.

11. A process in accordance with claim 1 wherein said reducing agent is selected in an amount of from about 0.5 to about 10 percent by weight of said toner.

12. A process in accordance with claim 1 wherein there results a toner with a positive triboelectric charge and substantial insensitivity to relative humidity.

13. A process in accordance with claim 1 wherein there results a toner with a triboelectric charge of from about 20 to about 60 microcoulombs per gram.

14. A process in accordance with claim 1 wherein there results a toner with a relative humidity sensitivity of from about 0.5 to about 1.

15. A process in accordance with claim 1 wherein said toner product is comprised of resin, colorant, and a substantially deoxygenated surface, and wherein there is present on said toner surface carboxylic acid groups and sulfonate groups reduced with said reducing agent.

16. A process for generating a charge on a toner comprised of subjecting the toner surface to mixing with a reducing agent and a metal halide.

17. A process in accordance with claim 16 wherein said metal halide functions as a catalyst.

18. A process in accordance with claim 17 wherein said catalyst is cobalt (II) chloride , zinc (II) chloride, or nickel chloride.

19. A process in accordance with claim 17 wherein said catalyst is cobalt (II) chloride, or zinc (II) chloride.

20. A process in accordance with claim 17 wherein said catalyst is cobalt (II) chloride selected in an amount of from about 0.5 to about 5 percent by weight of toner.

21. A process in accordance with claim 16 wherein said reducing agent is sodium borohydride or lithium borohydride.

22. A process in accordance with claim 16 wherein said reducing agent is sodium borohydride selected in an amount of from about 0.5 to about 10 percent by weight.

23. A process in accordance with claim 16 wherein said reducing agent is selected in an amount of from about 0.5 to about 10 weight percent by weight, and said metal halide is selected in an amount of from about 1.5 to about 8 weight percent.

24. A process in accordance with claim 16 wherein said halide is a catalyst selected in an amount of from about 0.5 to about 3 weight percent.

25. A process in accordance with claim 1 wherein said reducing agent is sodium borohydride selected in an amount of from about 0.5 to about 10 weight percent of toner, and said metal halide is cobalt (II) chloride selected in an amount of from about 0.5 to about 5 weight percent of toner.

26. A process in accordance with claim 1 wherein there results a reduction reaction and a change in the surface properties of said toner.

27. A process in accordance with claim 1 wherein said toner product is comprised of resin and colorant, and wherein the surface characteristics of said toner are converted from an initial state to a final state by said reducing agent.

28. A process in accordance with claim 27 wherein said metal halide is cobalt (II) chloride.

29. A process in accordance with claim 28 wherein said reducing agent is sodium borohydride.

30. A toner process comprising contacting a toner surface with a reducing agent and a metal halide, and wherein said metal halide is selected from the group comprising of cobalt (II) chloride, cobalt (II) bromide, cobalt (II) iodide, cobalt (II) fluoride, tin (II) chloride, tin (II) bromide, tin (II) iodide, tin (II) fluoride, zinc (II) chloride, zinc (II) bromide, zinc (II) iodide, zinc (II) fluoride, paladium (II) chloride, paladium (II) bromide, paladium (II) iodide, paladium (II) fluoride, cadmium (II) chloride, cadmium (II) bromide, cadmium (II) iodide, cadmium (II) fluoride, antimony (II) chloride, antimony (II) bromide, antimony (II) iodide, antimony (II) fluoride, copper (II) chloride, copper (II) bromide, copper (II) iodide, copper (II) fluoride, nickel (II) chloride, nickel (II) bromide, nickel (II) iodide, and nickel (II) fluoride, and wherein said metal halide and said reducing agent are mixed with a toner slurry and said resulting mixture is heated.

* * * * *